US006948392B2

(12) United States Patent
Eckard et al.

(10) Patent No.: US 6,948,392 B2
(45) Date of Patent: Sep. 27, 2005

(54) INERTIA DRIVE TORQUE TRANSMISSION LEVEL CONTROL AND ENGINE STARTER INCORPORATING SAME

(75) Inventors: David W. Eckard, Springfield, OH (US); John M. Birkhimer, Urbana, OH (US)

(73) Assignee: Tech Development, Inc., Dayton, OH (US)

( * ) Notice: Subject to any disclaimer, the term of this patent is extended or adjusted under 35 U.S.C. 154(b) by 47 days.

(21) Appl. No.: 10/384,333

(22) Filed: Mar. 7, 2003

(65) Prior Publication Data

US 2004/0173038 A1 Sep. 9, 2004

(51) Int. Cl.[7] ..... F02N 1/00
(52) U.S. Cl. ..... 74/7 C; 192/55.1
(58) Field of Search ..... 74/6–9; 192/55.1; 464/46

(56) References Cited

U.S. PATENT DOCUMENTS

| | | | | |
|---|---|---|---|---|
| 2,747,414 A | | 5/1956 | Cromwell et al. | |
| 2,796,766 A | | 6/1957 | Sabatini | |
| 2,901,912 A | | 9/1959 | Digby | |
| 2,902,864 A | | 9/1959 | Digby | |
| 2,922,307 A | | 1/1960 | Buxton | |
| 2,933,926 A | | 4/1960 | Buxton et al. | |
| 2,979,961 A | | 4/1961 | Spencer | |
| 2,996,924 A | | 8/1961 | Sabatini | |
| 3,222,938 A | | 12/1965 | Digby | |
| 3,263,509 A | | 8/1966 | Digby | |
| 3,686,961 A | * | 8/1972 | Campbell | 74/7 R |
| 3,851,532 A | * | 12/1974 | Pfluger et al. | 74/7 A |
| 4,019,393 A | | 4/1977 | Mortensen | |
| 4,194,412 A | | 3/1980 | Boyer | |
| 4,197,885 A | | 4/1980 | Mortensen | |
| 4,208,922 A | | 6/1980 | Mortensen | |
| 4,322,985 A | | 4/1982 | Mortensen | |
| 4,326,429 A | | 4/1982 | Mortensen | |
| 4,395,923 A | | 8/1983 | Giometti | |
| 4,425,812 A | | 1/1984 | Williams | |
| 4,464,576 A | | 8/1984 | Williams | |
| 4,524,629 A | | 6/1985 | Digby | |
| 4,611,499 A | | 9/1986 | Giometti | |
| 4,627,299 A | | 12/1986 | Mortensen, Sr. | |
| 4,661,715 A | | 4/1987 | Volino | |
| 4,695,735 A | | 9/1987 | Tallis, Jr. et al. | |
| 4,712,435 A | | 12/1987 | Losey et al. | |
| 4,715,239 A | | 12/1987 | Giometti | |
| 4,744,258 A | | 5/1988 | Volino | |
| 4,768,392 A | | 9/1988 | Giometti | |
| 4,777,836 A | | 10/1988 | Giometti | |
| 4,843,897 A | | 7/1989 | Tallis, Jr. | |
| 5,042,312 A | | 8/1991 | Giometti | |
| 5,596,902 A | * | 1/1997 | McMillen | 74/7 C |

* cited by examiner

*Primary Examiner*—David M. Fenstermacher
(74) *Attorney, Agent, or Firm*—Reinhart Boerner Van Deuren P.C.

(57) ABSTRACT

An engine starter inertia drive that includes a torque transmission level control mechanism is presented. Such torque transmission level control is provided by removing the variations in clutch plate compression force conventionally introduced by the shock absorbing meshing spring of the engine starter inertia drive. This is accomplished by repositioning the compression forces such that they are contradicted by a combination of the meshing spring force and the frame reaction of the engine starter. In this way, variations in the meshing spring force are compensated by equal and opposite variations in the frame reaction force to maintain the clutch plates in position. Preferably, a single wave spring is used to provide the pressure spring force on the clutch plates.

20 Claims, 6 Drawing Sheets

INERTIA DRIVE TORQUE TRANSMISSION LEVEL CONTROL AND ENGINE STARTER INCORPORATING SAME

FIELD OF THE INVENTION

The invention relates generally to engine starter inertia drives, and more particularly to torque transmission control for engine starter inertia drives.

BACKGROUND OF THE INVENTION

The success and profitability of many industries depends directly on the ability to operate equipment reliably and on demand. Equipment down time necessitated by repair or replacement of components adds unacceptably to the costs of operation, and reduces the ability to generate income from operation of that piece of equipment. It becomes critical, therefore, for all components used in such equipment to be rugged, reliable, and cost effective. It also becomes critical for such components to provide controlled operation that performs its function without adversely affecting the equipment of which it is a component.

In many industries, such as mining, power generation, oil and gas, and marine, heavy duty engines drive such equipment. Such engines may have displacements that may range from 5L (305 c.i.d.) to 300L (18,300 c.i.d.) or more. The first step in the operation of such equipment depends on the ability to reliability start the equipment's engine under a wide variety of conditions and environments. In industries that require the use of heavy duty engines, engine air starters that operate from an air/gas supply are typically used to perform such engine starting.

Such engine air starters typically employ a turbine air motor driven by the air/gas supply to rotate a shaft that is coupled to an engine starter drive. The engine starter drive is the mechanism that meshes with the ring gear and actually starts the engine. One such engine starter drive is known as an inertia drive. An inertia drive is coupled to the air motor output shaft via clutch plates, and includes a screw shaft on which a pinion gear rides. To start the engine, the turbine air motor is driven from the source of air/gas, which drives its output shaft. This rotary motion is coupled through the clutch plates to drive the screw shaft. The inertia of the pinion gear causes it to be translated along the screw shaft and into engagement with a ring gear of the engine. Once the pinion gear reaches the end of its travel along the screw shaft, it is fully meshed with the engine's ring gear. Continued rotation of the screw shaft rotates the pinion gear, which in turn rotates the ring gear of the engine to start the engine. Once the engine starts, it begins to accelerate the ring rear faster than the rotation of the screw shaft. This results in the pinion gear being translated along the screw shaft away from and out of engagement with the ring gear.

As can well be imagined by those skilled in the art, once the pinion gear has reached the end of its travel along the screw shaft and is fully meshed with the ring gear of the static engine, there is developed a large torque as the pinion gear attempts to accelerate the ring gear of the engine. As this torque is transmitted through the screw shaft, the clutch plates will slip if the torque rises above the spring force holding the clutch plates together. As the ring gear begins to rotate, the slip becomes less until the ring rear is being rotated by pinion gear without any slip at all.

The holding force on the clutch plates is critical to proper operation of the engine starter drive. If the clutch plates do not slip at the appropriate torque, either the engine will not start or serious damage may occur to either the engine or the starter, including the shearing of shafts, the breaking of gear teeth, etc. That is, if the force on the clutch plates is too light, the starting torque of the engine may not be overcome and the clutch plates will simply continue to slip without starting the engine. If the force on the clutch plates is too high, mechanical failure of engine or starter components may result (shearing shafts, breaking gear teeth, etc.). Such results are unacceptable. Further, with the cost sensitive nature of industry, both the engine and the starter are designed to operate within a fairly narrow tolerance band of torques before failure will occur.

In a conventional inertia drive engine starter, such as that shown in the partial cross sectional illustration of FIG. 6, the force that holds the clutch plates together is provided primarily by six pressure springs 100. These six pressure springs 100 are distributed around the periphery of the shaft head 102 on which the clutch disks 104 are mounted. The clutch body 106 is secured axially to the screw shaft 108 by a head screw/backstop 110. A meshing spring 112 also provides a force on the clutch plates 104 through the screw shaft 108 and clutch body 106. As is recognized by those skilled in the art, the meshing spring 112 is provided to allow some recoil of the screw shaft 108 and pinion 114 should the pinion 114 strike the engine ring gear (not shown) in its attempt to mesh therewith. The typical force applied by this meshing spring may be approximately 50 pounds, while the force applied by the six pressure springs 100 is typically approximately 500 pounds.

With the conventional construction as illustrated in FIG. 6, the inertia drive engine starter has a load schematic as illustrated in FIG. 7. As may be seen from this load schematic illustration, both the pressure springs and the meshing spring 112 apply their force against the clutch plate stack 104. These two combined spring forces from the pressure springs 100 and the meshing spring 112 act to compress the clutch plate stack 104 against the frame 116 to prevent slip between the clutch plates 104. These forces may be better understood with reference to the free body diagram of FIG. 8. As may be seen from this free body diagram, the pressure spring force 118 and the meshing spring force 120 on the clutch stack 104 is countered by the frame reaction force 122.

Unfortunately, with both the pressure springs and the meshing spring applying their forces against the clutch plates 104 in this configuration, any variation in the meshing spring force 120 will directly affect the ability of the clutch plates to maintain torque transfer without slippage. That is, in this conventional configuration, variations in the force of the meshing spring, which is meant to serve primarily a shock absorbing function, now directly affects the torque transmission capability of the entire clutch stack 104 in its primary function of transmitting torque to start the engine. As a result, the level of torque transmitted by the clutch plates is not controlled to a narrow range, but instead is subject to wide variations that may adversely affect starting performance as discussed above. In an exemplary embodiment of the conventional inertia drive engine starter having 500 pound pressure spring force and 50 pound meshing spring force, slip will occur in a range anywhere between 300 to 330 pounds. This wide, uncontrolled range of torque at which the clutch plates will slip increases the cost of ownership of such a drive resulting from increased wear if the slip occurs at too low a torque value, and excessive stress on the engine and starting components when the torque level is too high.

There exists, therefore, a need in the art for torque transmission level control within an inertia engine starter drive to ensure proper starting without damaging the engine or the starter drive components. Further, there exists a need for such a system to be cost effective.

BRIEF SUMMARY OF THE INVENTION

In view of the above, it is an objective of the present invention to provide a new and improved inertia engine starter drive. More particularly, it is an objective of the present invention to provide a new and improved inertial engine starter drive that includes torque transmission level control to ensure proper operation of the starter drive without damaging components of either the engine or the starter. Still more particularly, it is an objective of the present invention to provide such torque transmission control in a cost effective manner that reduces the number of parts and increases the reliability of the starter drive over conventional inertia engine starter drives.

In accordance with these objectives, an embodiment of the present invention provides an inertia engine starter drive that positions the spring force used to hold the clutch plates together in opposition to the meshing spring force.

In one embodiment, the present invention presents a torque transmission control mechanism for an engine starter inertia drive. The inertia drive includes a head adapted to be driven by a shaft from a source of rotational energy, a screw shaft having a pinion thereon adapted to engage an engine starting gear, a meshing spring adapted to be positioned between the shaft of the source of rotational energy, and the screw shaft to supply a first spring force to absorb axial shock loads in the case of pinion tooth to engine ring gear toth engagement. In this embodiment, the mechanism comprises a clutch plate stack accommodated on the head and contained within a clutch body. The clutch body is drivably coupled to the screw shaft. The mechanism further includes a pressure spring accommodated on the head and providing a second spring force on the clutch plate stack to control a value of torque that may be transmitted through the clutch plate stack without slippage. This second spring force is directed in opposition to the first spring force supplied by the meshing spring.

Preferably, the pressure spring is a wave spring. Further, the wave spring may be accommodated on the head by a an adjusting nut threadably received on the head. In such an embodiment, the second spring force may be adjusted by tightening and loosening the adjusting nut. That is, the value of torque that may be transmitted through the clutch plate stack may be varied by adjusting the second spring force. Preferably, the value of torque that may be transmitted through the clutch plate stack is unaffected by the first spring force. Further, the value of torque that may be transmitted through the clutch plate stack is unaffected by variations in the first spring force.

In an alternate embodiment of the present invention, an engine starter inertia drive comprises a head adapted to be driven by a source of rotational energy, a screw shaft, a pinion threadably mounted on the screw shaft adapted to engage an engine starting gear, and a clutch assembly including a clutch plate stack contained within a clutch body. The clutch body is drivably coupled to the screw shaft and to the head. The drive also includes a meshing spring adapted to be positioned between the source of rotational energy and the screw shaft. This meshing spring supplies a first spring force acting on the clutch plate stack in a first axial direction. Additionally, the drive includes a pressure spring providing a second spring force on the clutch plate stack to control a value of torque that may be transmitted through the clutch plate stack without slippage. The second spring force is directed in opposition to the first axial direction of the first spring force supplied by the meshing spring.

Preferably, the pressure spring is a wave spring. Further, the wave spring is accommodated on the head by a an adjusting nut threadably received on the head. In such an embodiment, the second spring force may be adjusted by tightening and loosening the adjusting nut. That is, the value of torque that may be transmitted through the clutch plate stack may be varied by adjusting the second spring force. Still further, the value of torque that may be transmitted through the clutch plate stack is unaffected by the first spring force. As such, the value of torque that may be transmitted through the clutch plate stack is unaffected by variations in the first spring force.

In a still further alternate embodiment of the present invention, a method of controlling a value of torque transmission in an engine starter inertia drive is presented. Such a drive preferably includes a head adapted to be driven by a source of rotational energy, a screw shaft having a pinion thereon adapted to engage an engine starting gear, and a clutch assembly including a clutch plate stack accommodated on the head and contained within a clutch body. The clutch body is drivably coupled to the screw shaft. The drive further includes a meshing spring adapted to be positioned between the source of rotational energy and the screw shaft to supply a first force to the clutch stack in a first axial direction. The method of this embodiment comprises the step of applying a second force to the clutch plate stack in a direction opposite to the first axial direction. This second force controls the value of torque transmission in the engine starter inertia drive.

In one embodiment, the method further includes the step of adjusting the second force to adjust the value of torque transmission in the engine starter inertia drive. Alternatively, the step of applying the second force to the clutch plate stack in the direction opposite to the first axial direction may comprise the step of eliminating susceptibility of the value of torque transmission to variations in the first force. Still further, the step of applying the second force to the clutch plate stack in the direction opposite to the first axial direction may comprise the step of applying the second force to the clutch plate stack such that the second force is opposed by a combination of a frame reaction and the first force. In such an embodiment, the step of applying the second force to the clutch plate stack such that the second force is opposed by the combination of the frame reaction and the first force comprises the step of allowing the frame reaction to compensate for variations in the first force such that the variations do not affect the value of torque transmission. In a further alternate, the step of applying a second force to the clutch plate stack in a direction opposite to the first axial direction comprises the step of supplying a wave spring positioned to apply the second force on a first end of the clutch plate stack opposite a second end of the clutch plate stack on which the first force is applied.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is not intent to limit it to those embodiments. On the contrary, the intent is to cover all alternatives, modifications and equivalents as included within the spirit and scope of the invention as defined by the appended claims.

DETAILED DESCRIPTION OF THE INVENTION

As discussed above, one problem with conventional engine starter inertia drives is the uncontrolled nature of the torque at which the clutch plates slip. Such uncontrolled torque values results in increased wear of the clutch plates if the torque value is too low, and increased stress on the starter and engine components if the torque value at which slip occurs is too high. Another problem associated with such conventional engine starter drives is the cost associated with the six pressure springs needed to maintain the force on the clutch stack. To overcome these problems, and with primary emphasis on the inability of the conventional engine starter drives to control the torque at which slip occurs to an acceptable, narrow range, the engine starter inertia drive of the present invention was developed.

Figure 1:
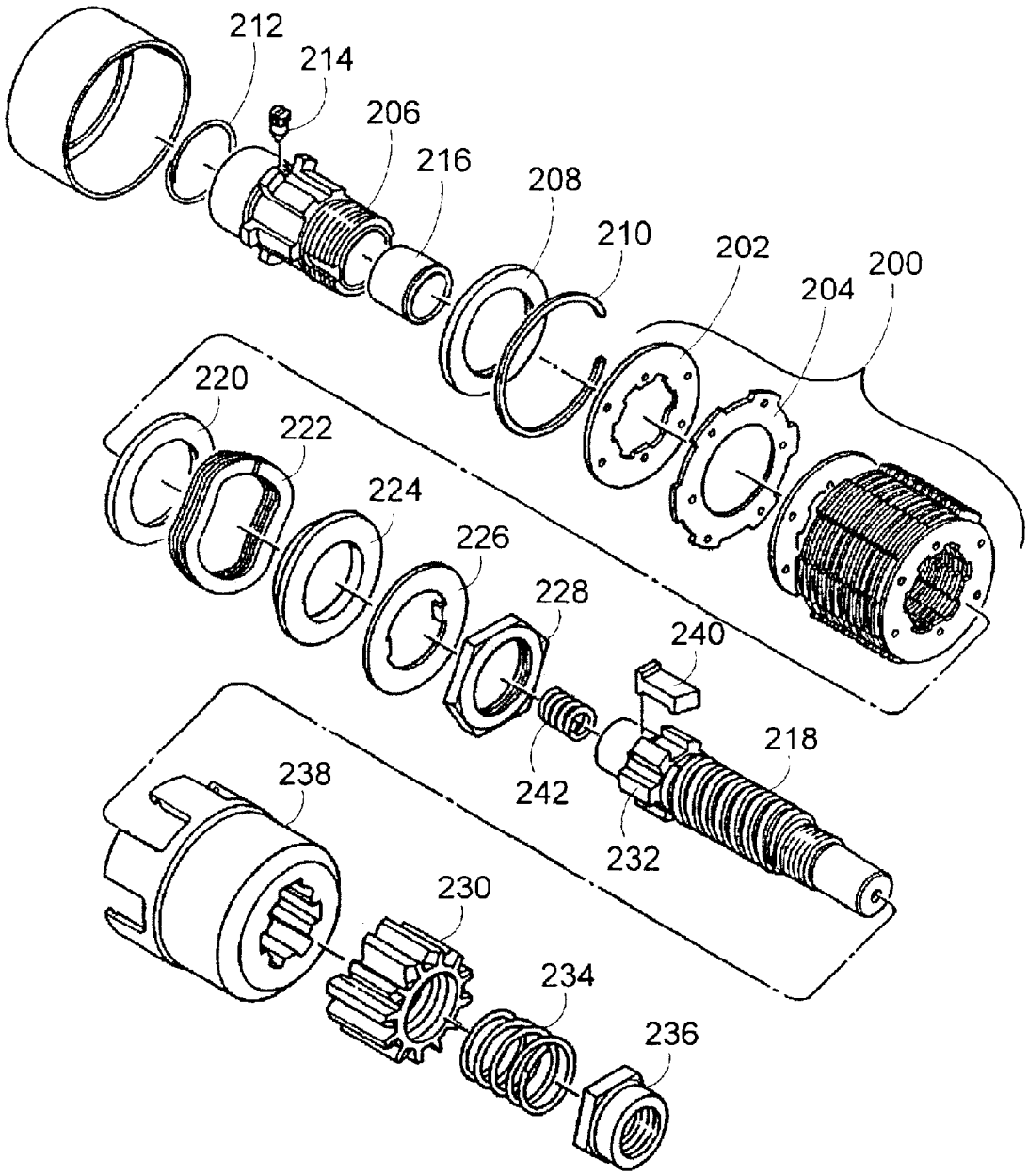
FIG. 1. is an exploded isometric view of one embodiment of an engine starter inertia drive constructed in accordance with the teachings of the present invention.

With reference to FIG. 1, there is illustrated an embodiment of the present invention in exploded isometric form. As may be seen in this FIG. 1, the clutch stack 200 is comprised of head disks 202 and body disks 204, preferably in alternating stacked arrangement to one another. This clutch stack 200 is positioned on the head shaft 206, along with a backing washer 208 and a disk retaining ring 210. A head screw lock ring 212 is also used to retain the head screw 214 in position. A bushing 216 is press fit within the head 206 and accommodates the insertion of the screw shaft 218 therein.

The clutch stack 200 is held together by a backing washer 220, a wave spring 222, an adjusting plate 224, a lock washer 226, and an adjusting nut 228. Once assembled, the adjusting nut 228 is adjusted to provide a controlled compressive force applied by wave spring 222 to the clutch stack 200. In a preferred embodiment, this compressive force applied by wave spring 222 is set at approximately 500 pounds. The actual force is determined by the load required to have the output torque at its desired value. Such operation completes the disk subassembly portion of the inertia drive engine starter of the present invention.

The shaft/pinion subassembly includes the screw shaft 218 on which the pinion 230 is positioned and aligned with the back stop portion 232 of the screw shaft 218. Once so positioned, the anti-drift spring 234 is positioned on the screw shaft 218, and is held in place by the stop nut 236. The clutch body 238 is then positioned on the screw shaft 218, and the back stop 240 is inserted in position. These two subassemblies are then assembled together and the meshing spring 242 is inserted therein. The clutch body 238 is held on the clutch stack 200 by the disk retaining ring 210. As will be understood by those skilled in the art, the head discs 202 of the clutch stack 200 do not rotate with respect to the head 206, and the body discs 204 do not rotate with respect to the clutch body 238. As will also be understood by those skilled in the art, while the embodiment shown in FIG. 1 utilizes a wave spring 222, other types and numbers of springs may be used in accordance with the teachings contained herein.

Figure 2:
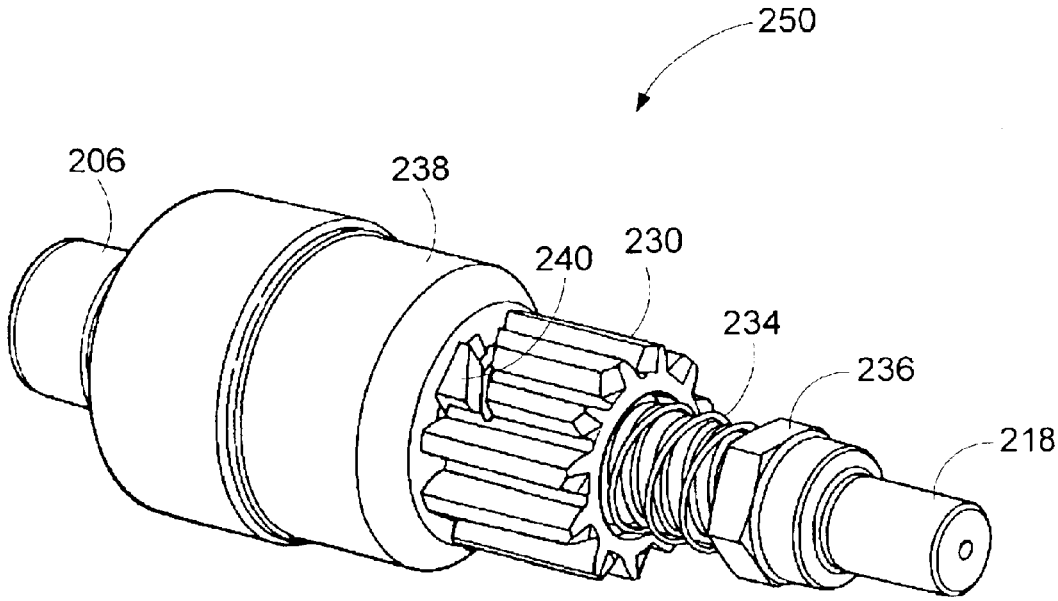
FIG. 2 is an isometric view of an assembled engine starter inertia drive constructed in accordance with the teachings of the present invention.
Figure 3:
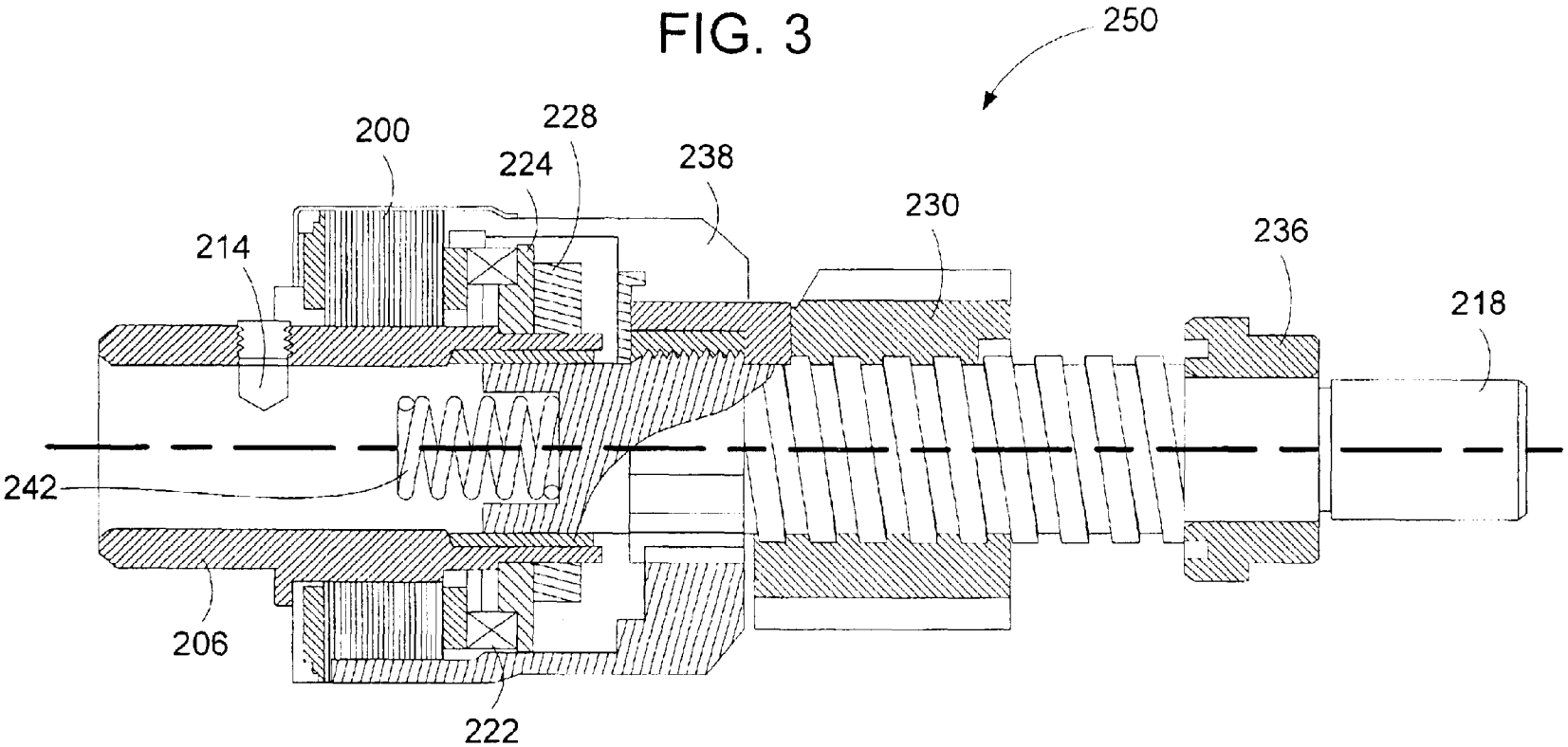
FIG. 3 is a cross-sectional illustration of the engine starter inertia drive of FIG. 2.

The completed engine starter inertia drive assembly of this embodiment of the present invention is illustrated in isometric form in FIG. 2, and in partial cross-sectional form in FIG. 3. As may be seen from the cross-sectional view of FIG. 3, placement of the wave spring 222 is forward of the clutch plate assembly 200, that is on the side of the clutch plate assembly 200 closer to the pinion 230. In this configuration, the spring force applied by the wave spring 222 is in a direction opposite to the spring force applied by the meshing spring 242 acting through the screw shaft 218 and clutch body 238. In this way, the shock absorbing function provided by the meshing spring 242 does not affect the torque value at which clutch plate slippage should occur as set by wave spring 222, As such, variations in the spring force provided by the meshing spring 242 will not cause a deviation in the controlled torque value that is set for the clutch plates by the wave spring 222.

Figure 4:
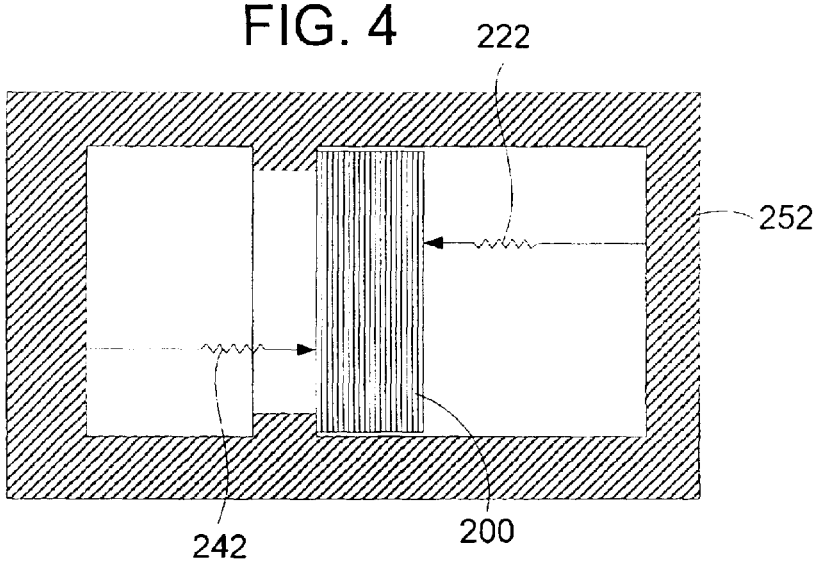
FIG. 4 is a load schematic of an engine starter inertia drive constructed in accordance with the teachings of the present invention.
Figure 7:
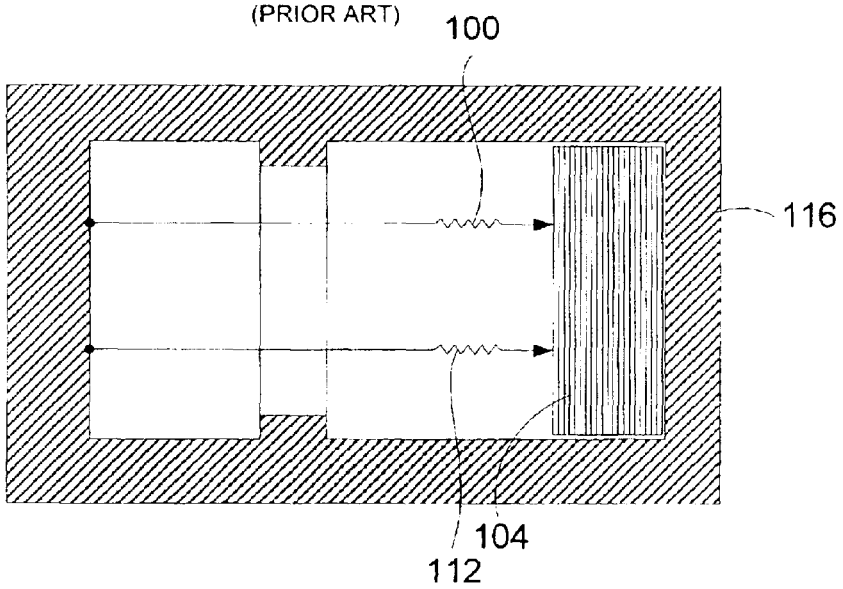
FIG. 7 (PRIOR ART)
FIG. 7 is a load schematic of the prior engine starter inertia drive of FIG. 6.
Figure 8:
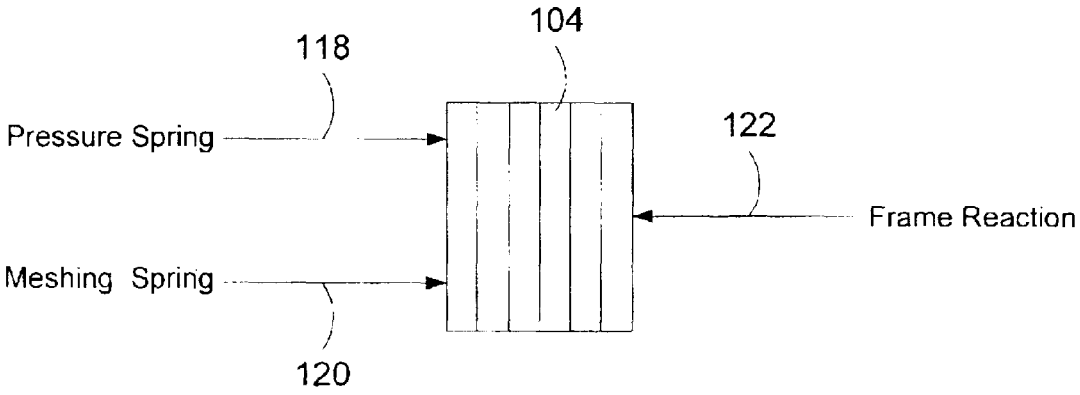
FIG. 8 (PRIOR ART)
FIG. 8 is a free body diagram of the prior engine starter inertia drive of FIG. 6.

This torque transmission control mechanism may better be understood through reference to the load schematic diagram of FIG. 4. As illustrated in this load schematic, the meshing spring 242 applies a force to the clutch plates 200 in a direction opposite to the force applied by the wave spring 222. As may be recalled from the load schematic of the conventional engine starter drive (see FIG. 7), both the pressure spring and meshing spring acted on the clutch plates in the same direction on the clutch plates.

Figure 5:
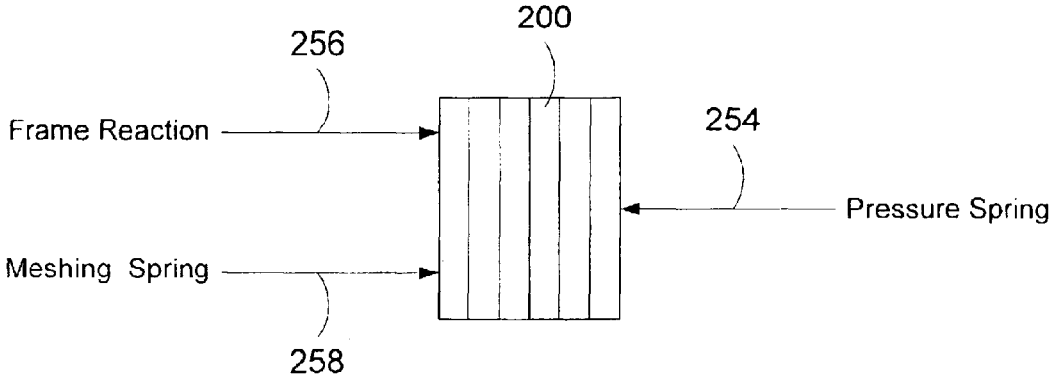
FIG. 5 is a free body diagram of an engine starter inertia drive constructed in accordance with the teachings of the present invention.
Figure 6:
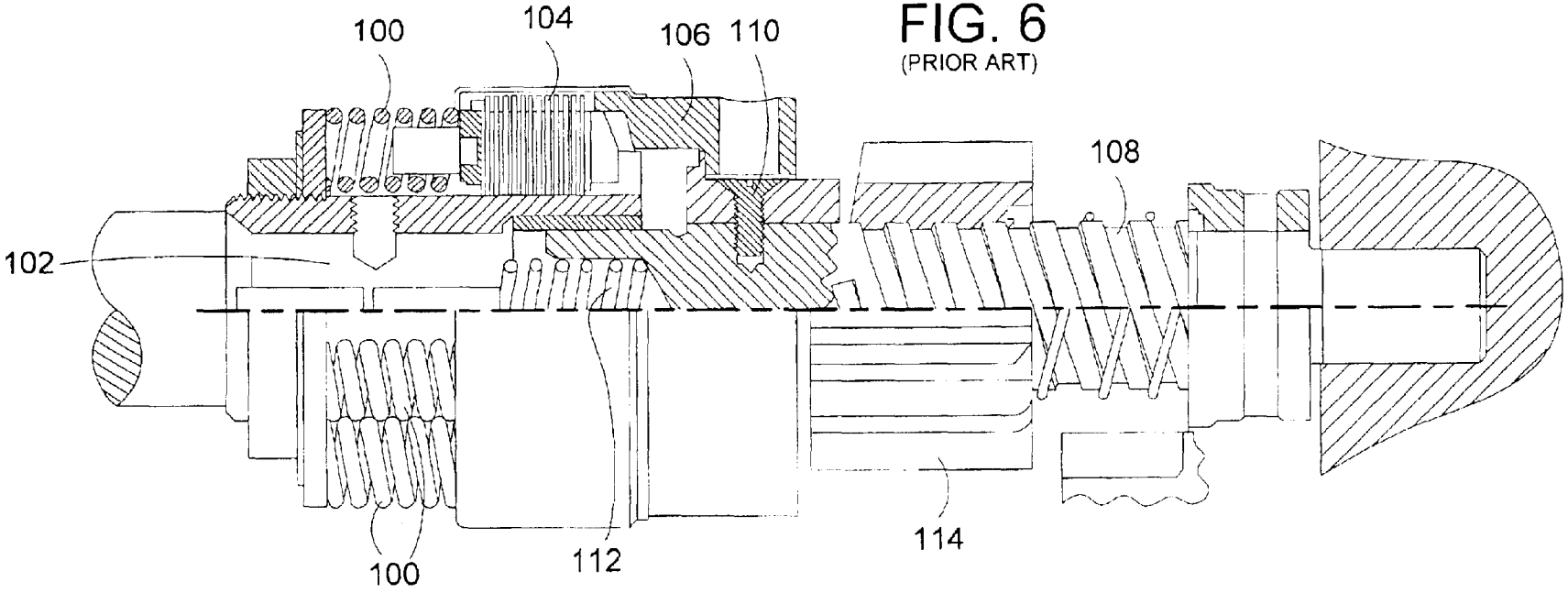
FIG. 6 (PRIOR ART)
FIG. 6 is a partial cross-sectional illustration of a prior engine starter inertia drive.

To fully understand the impact of this reconfiguration of the spring force on the clutch plates 200, reference is now made to the free body diagram of FIG. 5. As may be seen, the force 254 from the pressure spring is counteracted by a combination of the frame reaction force 256 and the meshing spring force 258. While the meshing spring force 258 is added to the frame reaction force 256, variations in this meshing spring force 258 will not have an effect on the torque at which the clutch plates 200 will slip, unlike the conventional engine starter. This is because variations in the meshing spring force 258 will be compensated by variations in the frame reaction force 256 that will inherently occur as the meshing spring force 258 increases or decreases. That is, if the meshing spring force 258 were wholly absent, the frame reaction force 256 would equal the pressure spring force 254 because the clutch plates 200 cannot move through the frame 252, but are instead abutted against it. As such, increases or decreases in the meshing spring force 258 will simply decrease or increase the required reaction force 256 from the frame to maintain the clutch plates 200 in their fixed position. As such, the torque value at which the clutch plates 200 will slip are now governed solely by the pressure spring force 254 applied thereto. The force 258 from the meshing spring is effectively removed from the load path.

This presents a substantial improvement over the conventional engine starter drive whose torque slip value varied over a wide range with the variations in the meshing spring force. While such variations may have been overcome through the usage of a meshing spring having a more controlled force, the crude shock absorbing function of the meshing spring did not justify the increased cost of using a precision spring. However, no such requirement of an expensive precision spring attaches with the engine starter drive of the present invention. This is because the torque value at which slip occurs is now governed solely by the pressure spring force 254 applied by the wave spring 222. Further cost reduction is realized in this embodiment through the replacement of the six pressure springs required in the conventional engine starter with the single wave spring 222 of this embodiment of the present invention. As a result, the inertia engine starter of the present invention provides very precise: control over the torque value at which the clutch plates will slip, while reducing the overall cost, and allowing for the use of an inexpensive meshing spring to perform the shock absorbing function in the event that the pinion runs into a tooth of the engine ring gear prior to meshing therewith.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A torque transmission control mechanism for an engine starter inertia drive, the inertia drive including a head, a screw shaft having a pinion thereon, a meshing spring to supply a first spring force to absorb axial shock loads, comprising:

a clutch plate stack accommodated on the head and contained within a clutch body such that the first spring force of the meshing spring acts on the clutch plate in a first direction, the clutch body drivably coupled to the screw shaft; and a pressure spring accommodated on the head and providing a second spring force on the clutch plate stack to control a value of torque that may be transmitted through the clutch plate stack without slippage thereof, the second spring force being directed in a second direction in opposition to the first spring force supplied by the meshing spring on the clutch plate stack.

2. The torque transmission control mechanism of claim 1, wherein the pressure spring is a wave spring.

3. The torque transmission control mechanism of claim 2, wherein the wherein the wave spring is accommodated on the head by a an adjusting nut threadably received thereon.

4. The torque transmission control mechanism of claim 3, wherein the second spring force may be adjusted by tightening and loosening the adjusting nut.

5. The torque transmission control mechanism of claim 1, wherein the value of torque that may be transmitted through the clutch plate stack may be varied by adjusting the second spring force.

6. The torque transmission control mechanism of claim 1, wherein the value of torque that may be transmitted through the clutch plate stack is unaffected by the first spring force.

7. The torque transmission control mechanism of claim 1, wherein the value of torque that may be transmitted through the clutch plate stack is unaffected by variations in the first spring force.

8. An engine starter inertia drive, comprising:

a head;

a screw shaft;

a pinion threadably mounted on the screw shaft;

a clutch assembly including a clutch plate stack contained within a clutch body, the clutch body drivably coupled to the screw shaft and to the head;

a meshing spring supplying a first spring force on the clutch plate stack in a first axial direction; and a pressure spring providing a second spring force on the clutch plate stack to control a value of torque that may be transmitted through the clutch plate stack without slippage thereof, the second spring force being directed in opposition to the first axial direction of the first spring force supplied by the meshing spring.

9. The engine starter inertia drive of claim 8, wherein the pressure spring is a wave spring.

10. The engine starter inertia drive of claim 9, wherein the wave spring is accommodated on the head by an adjusting nut threadably received thereon.

11. The engine starter inertia drive of claim 10, wherein the second spring force may be adjusted by tightening and loosening the adjusting nut.

12. The engine starter inertia drive of claim 8, wherein the value of torque that may be transmitted through the clutch plate stack may be varied by adjusting the second spring force.

13. The engine starter inertia drive of claim 8, wherein the value of torque that may be transmitted through the clutch plate stack is unaffected by the first spring force.

14. The engine starter inertia drive of claim 8, wherein the value of torque that may be transmitted through the clutch plate stack is unaffected by variations in the first spring force.

15. A method of controlling a value of torque transmission in an engine starter inertia drive having a head, a screw shaft having a pinion thereon, a clutch assembly including a clutch plate stack accommodated on the head and contained within a clutch body, the clutch body drivably coupled to the screw shaft, and a meshing spring supplying a first force to the clutch stack in a first axial direction, the method comprising the step of applying a second force to the clutch plate stack in a direction opposite to the first axial direction, the second force controlling the value of torque transmission in the engine starter inertia drive.

16. The method of claim 15, further comprising the step of adjusting the second force to adjust the value of torque transmission in the engine starter inertia drive.

17. The method of claim 15, wherein the step of applying the second force to the clutch plate stack in the direction opposite to the first axial direction comprises the step of eliminating susceptibility of the value of torque transmission to variations in the first force.

18. The method of claim 15, wherein the step of applying the second force to the clutch plate stack in the direction opposite to the first axial direction comprises the step of applying the second force to the clutch plate stack such that the second force is opposed by a combination of a frame reaction and the first force.

19. The method of claim 18, wherein the step of applying the second force to the clutch plate stack such that the second force is opposed by the combination of the frame reaction and the first force comprises the step of allowing the frame reaction to compensate for variations in the first force such that the variations do not affect the value of torque transmission.

20. The method of claim 15, wherein the step of applying a second force to the clutch plate stack in a direction opposite to the first axial direction comprises the step of supplying a wave spring positioned to apply the second force on a first end of the clutch plate stack opposite a second end of the clutch plate stack on which the first force is applied.

* * * * *

UNITED STATES PATENT AND TRADEMARK OFFICE

CERTIFICATE OF CORRECTION

PATENT NO. : 6,948,392 B2
DATED : September 27, 2005
INVENTOR(S) : David W. Eckard and John M. Birkhimer It is certified that error appears in the above-identified patent and that said Letters Patent is hereby corrected as shown below:

Column 8,
Line 3, after the word "plate", insert the word -- stack --.

Signed and Sealed this

Thirteenth Day of December, 2005

JON W. DUDAS
*Director of the United States Patent and Trademark Office*